United States Patent [19]

Kaporovich et al.

[11] Patent Number: 4,470,281

[45] Date of Patent: Sep. 11, 1984

[54] METHOD OF FORMING END FACE WALL HAVING CONCENTRIC RECESS IN TUBULAR WORKPIECE

[75] Inventors: Vladimir G. Kaporovich; Viktor G. Sereda; Valentina P. Chemeris; Vladimir V. Kaporovich; Viktor A. Makarychev, all of Kramatorsk; Varlen K. Pirogov, Moscow; Anatoly N. Gnutov, Moscow; Jury P. Sidorov, Moscow; Aron N. Tsoglin, Moscow; Boris S. Golberg, Nikolaev, all of U.S.S.R.

[73] Assignee: Kramotorsky Industrialny Institut, Kramotorsk, U.S.S.R.

[21] Appl. No.: 355,574

[22] Filed: PCT Jun. 26, 1980

[86] PCT No.: PCT SU 80/00106

§ 371 Date: Feb. 23, 1982

§ 102(e) Date: Feb. 23, 1982

[87] PCT Pub. No.: WO 82/00013

PCT Pub. Date: Jan. 7, 1982

[22] Filed: Feb. 23, 1982

[51] Int. Cl.[3] ..... B21D 41/04

[52] U.S. Cl. ..... 72/68; 72/69; 72/84; 72/342; 72/367

[58] Field of Search ..... 72/67, 68, 69, 81, 84, 72/85, 110, 111, 342, 348, 362, 367, 206; 29/148.4 D

[56] References Cited

U.S. PATENT DOCUMENTS

| | | | |
|---|---|---|---|
| 830,193 | 9/1906 | Andersson | 72/348 |
| 1,598,240 | 8/1926 | Carlson | 72/367 |
| 2,284,210 | 5/1942 | Johnson | 72/370 |
| 2,408,596 | 10/1946 | Bednar et al. | 72/84 |
| 2,449,247 | 9/1948 | Paucek | 72/69 |
| 3,814,040 | 6/1974 | Habash | 72/348 |
| 4,059,977 | 11/1977 | Kaporovich et al. | 72/81 |
| 4,061,009 | 12/1977 | Kaporovich et al. | 72/69 |
| 4,134,354 | 1/1979 | Cvacho et al. | 72/379 |
| 4,331,014 | 5/1982 | Miller et al. | 72/93 |

FOREIGN PATENT DOCUMENTS

| | | | |
|---|---|---|---|
| 2855948 | 6/1980 | Fed. Rep. of Germany . | |
| 2305368 | 10/1976 | France . | |
| 584938 | 12/1977 | U.S.S.R. . | |
| 688262 | 9/1979 | U.S.S.R. . | |
| 695744 | 11/1979 | U.S.S.R. . | |
| 797825 | 1/1981 | U.S.S.R. | 72/69 |

OTHER PUBLICATIONS

V. P. Romanovsky, "Spravochnik po Kholognoy Shtampovke" (Cold Stamping Handbook), 6-th Edition, 1979, Leningrad, Mashinostroenie Publishing House, pp. 128, 129.

O. V. Popov, "Izgotovlenie Tselnoshtampovannykh Tonkostennykh Detaley Peremennogo Secheniya" (Production of All-Stamped Thin-Walled Parts of Variable Sections), 1974, Moscow, Mashinostroenie Publishing House, pp. 57–62.

V. G. Kaporovich, "Obkatka v Proizvodstve Metalloizdeliy" (Rolling in Metal Products Manufacturing), 1973, Moscow, Mashinostroenie Publishing House, pp. 47, 83.

V. G. Kaporovich, "Proizvodstvo Detaley iz Trub Obkatkoy" (Production of Parts from Tubing by Rolling), 1978, Moscow, Mashinostroenie . Publishing House, pp. 129, 67–69, 16–17, 9.

*Primary Examiner*—Lowell A. Larson

*Attorney, Agent, or Firm*—Fleit, Jacobson, Cohn & Price

[57] ABSTRACT

In the method of invention a side wall of a tubular workpiece is deformed in the direction of closing the edges. From a vault thus obtained, an end face wall having a flat area in the zone of the top of the vault is preformed. The flat area is pressed inside the workpiece to form a recess by means of a pressing tool and simultaneously the end face wall is formed by means of externally rolling the workpiece, the material of the workpiece being positively transferred to the zone of bending the wall of the workpiece no matter what the distance is from the side wall to this zone. Thus, end face walls and recesses of various shapes at a wide range of dimensions may be obtained.

For deforming, the workpiece is preheated to a forging temperature.

4 Claims, 11 Drawing Figures

METHOD OF FORMING END FACE WALL HAVING CONCENTRIC RECESS IN TUBULAR WORKPIECE

TECHNICAL FIELD

The invention relates to the field of metal working and more particularly to methods of forming an end face wall having a concentric recess in a tubular workpiece, utilizing rolling.

BACKGROUND ART

The problem of forming an end face wall having a concentric recess in a tubular workpiece arose due to the necessity of considerably increasing the efficiency of manufacturing the bodies of belt conveyor rollers.

According to conventional methods, such bodies have been made of a case and inserts placed into the case and joined by welding or rolling-in therewith. Such methods are labour-consuming, low efficient and metal-wasting.

Making such bodies all-in-one by casting would only increase these disadvantages adding such ones as the limited choice in metal and dimensions of bodies and would also increase the amount of machining them.

The problem of forming all-in-one bodies of conveyor rollers in connection with known in the art methods of metal working may be taken as a general problem of forming a face wall having a concentric recess in a hollow cylindrical article.

Known in the art is a method of forming a recess in the bottom of a cylindrical body by reverse drawing (see V. P. Romanovsky, "Spravochnik po knolodnoy shtampovke" /Cold Stamping Handlbook/, 6th edition, 1979, Leningrad, "Mashinostroenie" Publishing House, pp. 128–129) comprising locating the body in a female die having an internal opening concentrical to the outer surface which is smoothly conjugated with the wall of the opening, and pressing the bottom into the opening of the female die by a male die. This results in bending the metal of the body according to the radius of the female die surfaces conjugation and thus in the formation of a concentric recess in the bottom.

The above method cannot be utilized for the production of all-in-one bodies of conveyor rollers because by this method a face wall having a recess may be obtained only at one end of a hollow cylindrical workpiece while the other end thereof is open. Moreover, a recess obtained by this method has a limited range of diameters which are dependent on the reduction ratio of the material.

The problem under consideration may be solved, for example, by unrestrictedly reversing a tubular workpiece end inwardly.

One of the methods utilizing such reversing consists in upsetting a tubular workpiece end in a die designed for the purpose by axially motioning the tubular workpiece while heating the metal of the workpiece in the area of deformation. This results in bending the wall of the workpiece according to a radius of free bend inside the tubular workpiece and moving the metal of the bent edge thereof in the direction opposite to motion of the remaining portion of the workpiece.

An internal neck is obtained in the workpiece, which neck is conjugated with the side wall of the workpiece by means of an end face having a toroidal surface (see O. V. Popov, "Izgotovlenie Tselnoshtampovannykh Tonkostennykh Detaley Peremennogo secheniya" /Production of All-Stamped Thin-Walled Parts of Variable Sections/, 1974, Moscow, Mashinostroenie" Publishing House, p.p. 57–62).

Necks of only a definite diameter depending on the external diameter of a workpiece may be obtained by the above method in thin-walled tubular workpieces because under other conditions the method is unstable. Moreover, the shape of the end face wall of the workpiece cannot be another than toroidal. Besides, the efficiency of the method is decreased by the necessity of heating in the area of deformation.

The abovementioned disadvantages of the prior art methods of stamping on one hand, and the equipment simplicity and high efficiency of prior art methods of rolling on the other hand helped the workers in the art to adhere to the latter methods in searching for the ways of manufacturing all-in-one bodies of conveyor rollers.

Known in said field is a method of forming in a cylindrical article an end face wall having a concentric recess of any predetermined size and shape by sequentially rolling, first, the recess and, then, the end face wall and the side wall of the article from a sheet round stock (see V. G. Kaporovich, "Obkatka v proizvodstve metalloizdeliy" /Rolling in Metal Products Manufacturing/, 1973, Moscow, "Mashinostroenie" Publishing House, p. 97).

However, this method is suitable only for forming hollow cylindrical articles having an open end and the diameter which is commensurable with the length thereof while said bodies comprise the aforementioned end face walls having recesses at both ends thereof and their length is several times the diameter thereof.

Known in the art is a method of forming an end face wall having a concentric recess in a tubular workpiece, which is a step in a process of manufacturing a steel flask (see V. G. Kaporovich, "Proizvodstvo detaley iz trub obkatkoy" /Production of Parts from Tubing by Rolling/, 1978, Moscow, "Mashinostroenie" Publishing House, p.p. 129, 67–69, 16–17). The method comprises deforming a side wall of a workpiece at an end thereof in the direction of closing the workpiece end edges to the formation of a vault, forming a face wall from the obtained vault, and reversing said end of the rotated workpiece inwardly at a forging temperature. Deforming the side wall and forming the face wall is performed sequentially by means of different tools for rolling fixed, in this case, in a single holder. Reversing the end inwardly is performed by the method of U.S. Pat. No. 2,449,247, Cl. 72–69, 1948, comprising axially feeding a tool of a special design being rotated about its axis. The tool comprises a body provided with a central bore and an inward projection at the bottom thereof. Three U-shaped pins of a wear-resistant material are pressure-fitted into said bore so that each of them follows the side wall, a part of the bottom and the projection and protrudes from the internal surface of the body at 0.20–0.35 of the pin's diameter. In the process of axially feeding, the end of the workpiece is heated up to a forging temperature. The side wall of the workpiece serves as a guide in the axial motion of the tool whose projection presses through the preformed face wall inwardly. The recess formed in the end face wall of the workpiece opens up thus forming a through neck due to the pressure of the tool projection.

Forming the shape of the tubular workpiece by reversing is possible only after the radius which is equal to or less than a free bend radius (see O. V. Popov, "Izgotovlenie tselnoshtampovannyh tonkostennyh detaley peremennogo sechenia" /Production of All-Stamped Thin-Walled Parts of Variable Sections/, 1974, Moscow, "Mashinostroenie" Publishing House, p.p. 57–58). That is why by this method may be obtained an internal neck the diameter of which cannot be less than $D_e-4R$, where $D_e$ is the external diameter of the tubular workpiece portion to be deformed and R is a radius of free bend which is quite a definite value for any tubular workpiece and depends upon the diameter and the wall thickness thereof. The internal neck is conjugated with the side wall of the workpiece by means of the end face wall, which cannot be other than toroidal-shaped (circumscribed by said radius). An additional step is required to form the end face wall of other shape.

To disadvantages of the described method may also be related the fact that the reversing operation may proceed steadily only with tubes whose diameter is up to 50 mm and a relative wall thickness $((t/D_e)=100\%$, where t is the wall thickness) is not more than 3.5%. Exceeding said limits leads to considerably thickening the wall in the area of deformation, which hampers steady proceeding of the operation.

Thus, the performance capabilities of the described method are limited in both the choice in the initial dimensions of the workpiece and in the dimensions and the shapes of the end face walls and necks (recesses) to be formed.

DISCLOSURE OF INVENTION

The object of the invention is to provide a method of forming an end face wall having a concentric recess in a tubular workpiece, which enlarges both the range of the dimensions of the workpieces to be used and the range of the dimensions and the shapes of face walls and recesses to be obtained as the result of a continuous motion of the metal of the workpiece to the area of bending the wall thereof in the operation of reversing inwardly.

The object is attained by providing a method of forming an end face wall having a concentric recess in a tubular workpiece comprising deforming the side wall at an end of the workpiece in the direction of closing the end edges to form a vault, forming an end face wall from the obtained vault, and reversing said end of the rotated workpiece inwardly at a forging temperature. According to the invention, forming the end face wall is accomplished in two stages. At the first stage, the end face wall is formed with a formation, at the top of the vault, of a flat area having a diameter exceeding that of the bottom portion of the recess by a value of 2R to 3R, where R is a radius of free bend in the wall of the workpiece.

The second stage—finally forming the end face wall—is carried out simultaneously with reversing the workpiece end inwardly by pressing said flat area inside the workpiece by means of a pressing tool conforming to the shape and the dimensions of the recess, and finally forming the end face wall is carried out by externally rolling the workpiece by means of a rolling tool.

The flat area in the centre of the preformed end face wall provides for a rigid support for the pressing tool. If such area is absent, or if its diameter is smaller than that of the tool, upsetting the end face wall will take place without pressing the end face wall of the workpiece inwardly. The abovementioned excess in the diameter of the flat area over that of the bottom portion of the recess to be obtained (equal to the end face of the pressing tool) ensures the required conditions for pressing the recess in the end face wall of the workpiece. A decrease in the diameter of the flat area below said lower limit results in tearing off the bottom portion of the recess in the operation of pressing. An increase in this diameter over said upper limit results in inadmissible deviations from a predetermined geometrical shape of the recess.

A combination of the processes of inwardly pressing and externally rolling allows the metal of the workpiece to be continuously and positively transferred to the area of bending the wall thereof in the operation of inwardly pressing. That is why in forming the wall of the recess the material consumed is readily replenished with the end face wall material (or, if need be, with the side wall material as well), which is transferred by the rolling tool into the area of inwardly pressing. This permits obtaining recesses practically unlimited in depth and of a wide range in diameter. When this method is utilized, the lower limit of the recess diameter depends only upon the conditions of the strength of the pressing tool and the upper limit, upon the external diameter of the workpiece minus a quadruple diameter of free bend. Moreover, the continuous and positive transference of metal into the area of bending prevents forming the wall buldes which can hamper the steadiness of the process. This provides for an opportunity to extend the range of the dimensions (diameters and relative wall thicknesses) of the utilized workpieces.

In the particular case, finally forming the end face wall may be accomplished by externally and tangentially rolling the workpiece. It is to be noted that in the case of processing a steel workpiece the ratio of the feed rate of the pressing tool to the feed rate of the rolling tool should be chosen within the range of 0.40 to 0.75. If said upper limit is exceeded, a tool of friction does not manage with feeding the material into the area of inwardly pressing and that results in distorting the shape of the recess to be obtained as compared with the predetermined shape.

If the feed rate ratio is less than said lower limit, the material is fed to the pressing tool excessively and that leads to a formation of wrinkles in the article and, in some cases, to a rupture in the recess wall or to a complete tearing off of the recess.

At the stage of preforming, the end face wall should preferably be fashined into a truncated cone having the angle of inclination of the generating line to the axis within 30° to 40°. This creates the most favourable conditions for forming an end face wall having a recess by providing the shortest distance in transferring the material to the area of inwardly pressing and a smaller wall rigidity, as compared with that of a curvilinear vault, thus facilitating the operation of deforming. Moreover, such a shape allows the design of a rolling tool and the calculation of technological fillets to form a recess of desired dimensions to be simplified.

Following said range of values of angles of inclination of the truncated cone generating line ensures a sufficient precision of an end face and a recess being obtained at an optional power consumption. An excess in said upper limit results in an end face wall of unjustified thickness. With an angle of inclination below said lower limit, the rigidity of an end face wall increases and the power consumption required for pressing a recess also increases.

BRIEF DESCRIPTION OF DRAWINGS

Now the invention will be explained by particular embodiments thereof and by the accompanying drawings in which.

BEST MODE FOR CARRYING OUT THE INVENTION

The method of forming an end face wall having a concentric recess in a tubular workpiece according to the preferred embodiment of the invention consists in the following.

Figure 1:
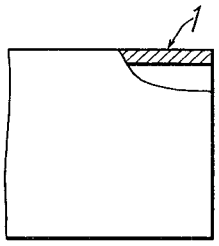
FIG. 1 illustrates a tubular workpiece end being processed.
Figure 2:
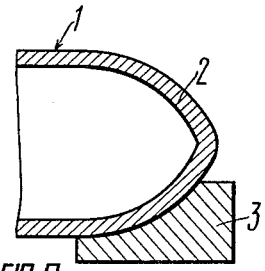
FIG. 2 illustrates forming a vault in the tubular workpiece in accordance with the method of the invention.
Figure 3:
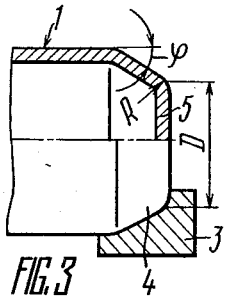
FIG. 3 illustrates preforming an end face wall in accordance with the method of the invention.

In a tubular workpiece 1 (FIG. 1), an end which is desired to be processed is heated to a forging temperature, which, for example, for steel is from 950° C. to 1250° C. Then the cold end of the workpiece is fixed in a spindle chuck of a rolling machine and the workpiece is rotated at a speed of 350 r.p.m. to 800 r.p.m. A lathe may be used, in particular, as the rolling machine. The side wall of the heated end of the workpiece 1 is deformed in a manner known to the art in the direction of closing the end edges to form a vault 2 (FIG. 2) by tangentially rolling by means of a friction tool 3. An end face wall is preformed by means of the same tool 3 correspondingly gauged, which end face wall is fashioned at this stage of processing into a truncated cone 4 (FIG. 3) having a flat area 5 in a zone which corresponds to the position of the top of the vault 2 (FIG. 2).

A diamter D of the flat area 5 (FIG. 3), which is measured on a circumference lying on an intersection on the external surface of this flat area and a continuation of the side surface of the cone 4, is chosen so that it should be larger than that of the bottom portion of the recess by a value of 2R to 3R, where R denotes a radius of a free bend of the workpiece wall, which in the known manner depends upon the wall thickness and the workpiece diameter. An angle of inclination between the generating line of the truncated cone 4 and the axis thereof is chosen within 30° to 40°.

Figure 4:
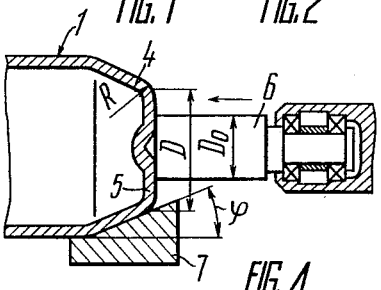
FIGS. 4 to 8 illustrate sequential stages of forming a recess with simultaneously and finally forming the end face wall in accordance with the method of the invention.

Further processing (FIG. 4) is carried out simultaneously by means of two tools: a pressing tool 6 and a rolling tool 7. The pressing tool 6 is shaped in the form of a mandrel whose shape and dimensions correspond to the predetermined shape and dimensions of the recess. The mandrel is rotatably fixed in the tailstock spindle of a lathe. The rolling tool 7 is known to the art friction tool (see, for example, V. G. Kaporovich, "Proizvodstvo detaley iz trub obkatkoy" /Production of parts from Tubing by Rolling/, 1978, Moscow, "Mashinostroenie" Publishing house, p. 9), which is constructed of a rectangular bar profiled for tangentially rolling so that the angle of inclination of the working surface generating line thereof should continuously vary from an angle $\phi$ of the cone 40 to the predetermined angle of inclination between the generating line of the end face wall and the axis of rotation of the workpiece, which, in the example illustrated by the drawing, is 90°. The tool 7 is mounted on the support of the same lathe.

The tool 6 is moved in the direction to the workpiece till it contacts with the flat area 5, and the tool 7 is brought in contact with the side surface of the cone 4. Then the axial feed of the tool 6 and the tangential feed (perpendicular to the axis of rotation of the workpiece) are simultaneously applied.

The tool 6, contacting by means of its front end face with the flat area 5, presses the end face wall of the workpiece inwardly in the direction of the feed, the flat area 5 being shifted in parallel to itself due to bending (reversing) the conical portion of the end face wall. The choice in diametric dimensions of the flat area 5 within the aforementioned range ensures the formation of a bend in the end face wall along the perimeter of the bottom portion of the recess to be obtained. If a diameter of the flat area equals to $D<D_o+2R$, the flat area may be torn off said place. This would not only cause a distortion of the wall of the recess (which is admissible for some kinds of articles), but absolutely exclude a possibility of forming a recess of the predetermined depth.

If the diameter equals to $D>D_o+3R$, the portion of bending would depart from the face of the tool 6 by an indefinite distance, which would result in deviations from the predetermined geometrical shape and the cross-sectional dimensions of the recess.

To avoid an excessive accumulation of metal in the end face wall being finally formed, the inclination angle of the generating line of the cone 4 must not exceed said upper limit (40°). The value of the lower limit of this angle restricts the power consumption for feeding the tool 6 in the operation of inwardly pressing.

Dealing with articles whose precision requirements are strict, it is necessary that the bend place corresponding to the junction between the end face wall and the wall of the recess being formed, at every moment of deformation be at a maximum reachable proximity to the side surface of the tool 6. This allows forming a recess whose shape and dimensions correspond to the profile of the tool 6. For this purpose, the feed speeds for the tool 6 and the tool 7 are chosen according to a definite ratio which depends upon the material and the relative dimensions of a workpiece and which is determined by practical considerations. In particular, for steel workpieces of 50 mm to 150 mm in diameter and of a wall thickness ratio to the diameter of up to 0.04, said ratio of feed speeds is within the range of 0.40 to 0.75.

An excess in the upper limit of said range results in that the rolling tool 7 does not manage to transfer the metal of a workpiece to the place of bending the wall of the workpiece, the position of which metal is being changed as the pressing tool 6 is moving. As a result, the predetermined geometrical shape of the recess may be distorted. With the ratio chosen below 0.40, it results in an excessive feed of metal to the place of bending, which may cause the occurence of wrinkles, local bucklings, and the recess wall ruptures.

Figure 5:
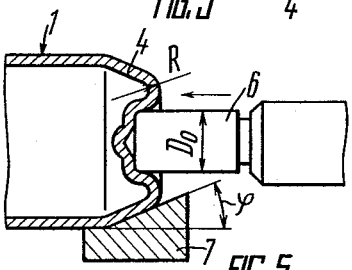
Figure 6:
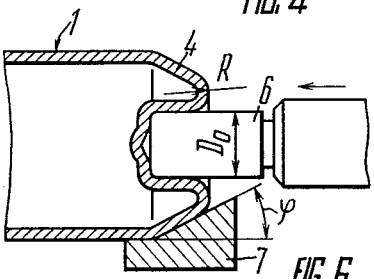
Figure 7:
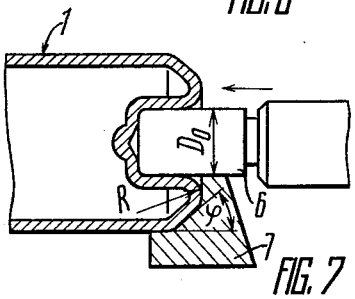
Figure 8:
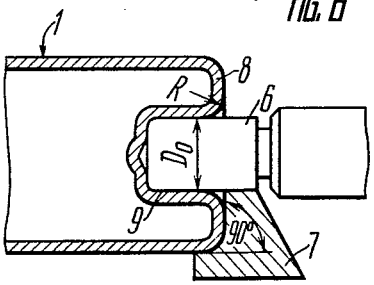

To facilitate the calculation of the travel of the tool 6 in order to obtain a recess of a predetermined shape, the tool 7 is gauged so that in rolling the conical surface of the workpiece the generating line of this surface first travels in parallel to itself (FIGS. 5–6) and then turns to an angle which supplements the initial angle $\phi$ of the inclination of said generating line up to the predetermined angle of inclination between the generating line of the end face and the axis of the workpiece (FIGS. 7 and 8). In this case, the depth of the obtained recess is equal to the sum of the travel of the tool 6 during rolling the conical surface with the parallel travel of the generating line and of the travel of the same tool with the generating line being turned. The operation of rolling is performed in a single stroke of the tool 7. And all the described processing is carried out with a single heating of the workpiece. After an end face 8 and a recess 9 (FIG. 9) of predetermined shapes and dimensions are obtained, the tools 6 and 7 are retracted to their initial positions and the processed article is released from the spindle chuck of the lathe.

For better understanding of the invention, it will be explained now by the following particular examples.

EXAMPLE 1

A tubular workpiece of a structural steel containing about 0.20 percent of carbon was deformed in order to obtain a flat end face wall having a concentric cylindrical recess with a diameter $D_o$ of 40 mm and a depth h of 40 mm (FIG. 8). The external diameter $D_e$ of the workpiece was equal to 108 mm and the thickness of the wall was equal to t=4 mm. The end of the workpiece to be processed was heated to a temperature of 1100° C. and the other end thereof was fixed in the spindle chuck of a lathe. A rotation with a speed n, equal 375 r.p.m., was applied to the spindle of the lathe. The side wall of the workpiece was subjected to the operation of rolling in the direction of closing the end edges, and a truncated cone having an inclination angle between the generating line thereof and the axis of rotation $\phi$, equal 30°, was preformed. The diameter D of the flat area, corresponding to the smaller diameter of the truncated cone, was equal 65 mm. Then, by axially feeding ($V_o$=m/s) a cylindrical pressing tool having a diameter $D_o$ equal 40 mm, a recess was pressed simultaneously with externally rolling the conical surface of the end face wall by means of a friction tool whose tangential feed was equal to $V_\tau$=10 m/s. The angle of inclination between the generating line of this surface and of the axis of rotation of the workpiece was varied from 30° to 90°.

All the operation of forming the end face wall having a concentrical recess was accomplished in the tubular workpiece at a single heating. Finally forming the end face wall was carried out at a single stroke of the cross-slide of the lathe.

The wall of the workpiece was bent in accordance with the radius corresponding to the radius of free bend R=13. The quality of the surface of the obtained recess and of the end face was good, and wrinkles and other defects were not observed.

EXAMPLE 2

Figure 9:
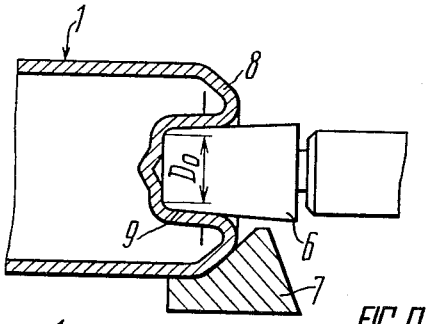
FIGS. 9 to 11 illustrate the finishing stage of forming the recess with simultaneously and finally forming the end face wall in accordance with the embodiments of the invention.

A tubular workpiece of a structural steel containing about 0.45 percent of carbon was deforming in order to obtain a conical end face wall having a concentric recess of a conical shape as well (FIG. 9). The workpiece diameter $D_e$ was equal to 76 mm; the wall thickness, 3 mm.

Set parameters: the inclination angle between the generating line of the end face wall of the cone and of the axis thereof equals 50°; the intersection point of the generating line thereof (the apex of the cone) is directed outside, the diameter $D_o$ of the bottom portion of the recess was equal to 20 mm, the depth thereof h equal to 26 mm.

The workpiece end processed was heated to a temperature of 1200° C. Further processing was carried out in the same succession as described in the Example 1 with the following parameters:

- the speed of rotation of the lathe spindle n=600 r.p.m.;
- the diameter of the flat area of the preformed end face wall (the wall is shaped into a truncated cone); D=60 mm;
- the angle of inclination between the generating line of the same truncated cone and the axis of rotation of the workpiece $\phi$=40°;
- the axial feed of the pressing tool $V_o$=10 mm/s;
- the tangential feed of the rolling tool $V_\tau$=15 mm/s.

The angle of inclination between the generating line of the cone of the end face wall and the axis of rotation of the workpiece during the operation of finally forming this wall was varied from 40° to 50°.

The wall of the workpiece was bent in accordance with the radius corresponding to the radius of free bend R=10 mm.

The quality of the surface of the obtained recess and the end face wall was good; the formation of wrinkles and other defects were not observed.

EXAMPLE 3

A tubular workpiece of a chrome-silicon-manganese steel, containing about 0.30 percent of carbon and 1 percent of each element: manganese, silicon, and chromium, was deformed in order to obtain a flat end face wall having a cylindrical recess with a diameter of 50 mm and a depth of 60 mm (FIG. 8). The diameter $D_e$ of the workpiece was equal to 133 mm, and the thickness of the wall was equal to t=5 mm. The workpiece end processed was heated to a temperature of 1200° C. Further processing was carried out in the same succession as described in the Example 1 with the following parameters:

- n=375 r.p.m.;
- D=90 mm;
- $\phi$=35°;
- $V_o$=15 mm/s;
- $V_\tau$=25 mm/s.

The angle of inclination between the generating line of the cone of the end face wall and the axis of rotation of the workpiece in the operation of finally forming was varied from 35° to 90°. The wall of the workpiece was bent in accordance with the radius corresponding to the radius of free bend R=16 mm.

The quality of the surface of the obtained recess and of the end face was good, the formation of wrinkles and other defects were not observed.

EXAMPLE 4

(Comparative)

A tubular workpiece of a chrome-nickel-titanium steel containing about 0.1 percent of carbon, 1.5 percent of manganese, 0.7 percent of silicon, 16 percent of chrome, and 0.6 percent of titanium was deformed in order to obtain a flat end face wall having a cylindrical recess with a diameter of 30 mm and a depth of 40 mm (FIG. 8). The diameter $D_e$ of the workpiece was equal to 89 mm and the wall thickness to t=3 mm. The workpiece processed was heated to a temperature of 1200° C. Further processing was carried out in the same succession as described in the Example 1 with the following parameters:

n=500 r.p.m.;
D=50 mm;
$\phi$=25°;
$V_o$=6 mm/s;
$V_\tau$10 mm/s.

The angle of inclination between the generating line of the cone of the end face wall and the axis of rotation of the workpiece in the operator of finally deforming this wall was varied from 25° to 90°.

The wall of the workpiece was bent in accordance with the radius corresponding to the radius of free bend R=10 mm.

The quality of the surface of the obtained recess and of the end face was good and the formation of wrinkles and other defects were not observed. An increase of power consumption in the workpiece rotation was due to the too small inclination angle of the generating line of the cone of the preformed end face wall.

EXAMPLE 5

(Comparative)

A tubular workpiece of a chrome-nickel-molybdenum steel containing about 0.4 percent of carbon, 0.65 percent of manganese, 0.30 percent of silicon, 0.7 percent of chrome, 1.45 percent of nickel, and 0.20 percent of molybdenum was deformed in order to obtain a flat end face wall having a cylindrical recess with a diameter of 40 mm and a depth of 45 mm (FIG. 8). The diameter $D_e$ of the workpiece was equal to 108 mm, the wall thickness t=3 mm.

The workpiece end processed was heated to a temperature of 1150° C. Further processing was carried out in the same succession as described in the Example 1 with the following parameters:

n=750 r.p.m.;
D=78 mm;
$\phi$=45°;
$V_o$=5 mm/s;
$V_\tau$=8 mm/s.

The inclination angle between the generating line of the cone of the end face wall and the axis of rotation of the workpiece in the operation of finally forming this wall was varied from 45° to 90°.

The wall of the workpiece was bent in accordance with the radius corresponding to the radius of free bend R=13 mm.

The quality of the surface of the obtained recess and of the end face was good, the formation of wrinkles and other defects were not observed.

A considerable increase in the wall thickness in the end face portion as compared with the initial wall thickness of the workpiece was observed due to a large inclination angle of the generating line of the cone of the preformed end face wall.

EXAMPLE 6

(Comparative)

A tubular workpiece of a structural steel containing about 0.1 percent of carbon was deformed in order to obtain a conical end face wall (the apex of the cone is directed outside, the inclination angle between the generating line and the axis is 60°) having a cylindrical recess with a diameter of 30 mm and a depth of 40 mm. The diameter of the workpiece was $D_e$=108 mm and the wall thickness was t=3.5 mm. The workpiece end processed was heated to a temperature of 950° C. Further processing was carried out in the same succession as described in the Example 1 with the following parameters:

n=750 r.p.m.;
D=80 mm;
$\phi$=30°;
$V_o$=6 mm/s;
$V_\tau$=12 mm/s.

The inclination angle between the generating line of the cone of the end face wall and the axis of rotation of the workpiece was varied from 30° to 60° in the operation of finally forming this wall.

The wall of the workpiece was bent in accordance with the radius corresponding to the radius of free bend R=15 mm.

The quality of the surface of the obtained end face wall was good, the surface of the recess was corrugated, the deviations from the predetermined dimensions of the recess were also observed due to an excessively large increase in the diameter D of the flat area with respect to the diameter of the pressing tool.

EXAMPLE 7

(Comparative)

A tubular workpiece of a chromium steel containing about 0.38 percent of carbon, 0.65 percent of manganese, 0.25 percent of silicon, and 1 percent of chrome was deformed in order to obtain a flat end face wall having a cylindrical recess with a diameter of 30 mm a depth of 30 mm (FIG. 8). The diameter of the workpiece was equal to $D_e$=60 mm, the wall thickness was equal to t=2 mm. The workpiece end processed was heated to a temperature of 1200° C. Further processing was carried out in the same succession as described in the Example 1 with the following parameters:

n=750 r.p.m.;
D=38 mm;
$\phi$=40°;
$V_o$=5 mm/s;
$V_\tau$=10 mm/s.

The inclination angle between the generating line of the cone of the end face wall and the axis of rotation of the workpiece was varied from 40° to 90° in the operation of finally forming this wall.

The wall of the workpiece was bent in accordance with the radius corresponding to the radius of free bend R=7 mm.

The too small diameter D of the flat area in the preformed end face wall caused the bottom portion of the recess to tear off therefrom in the operation of pressing the recess and simultaneously rolling the cone.

EXAMPLE 8

(Comparative)

A tubular workpiece of a structural steel containing about 0.2 percent of carbon was deformed in order to obtain a flat end face wall having a cylindrical neck with a diameter of 40 mm and a depth of 40 mm (FIG. 8). The diameter of the workpiece was equal to $D_e$=108 mm, the wall thickness was equal to t=4 mm. The workpiece end processed was heated to a temperature of 1250° C. Further processing was carried out in the same succession as described in the Example 1 with the following parameters:

n=375 r.p.m.;
D=65 mm;
$\phi$=30°;
$V_o$=9 mm/s;

$V_t$=10 mm/s.

The inclination angle between the generating line of the cone of the end face wall and the axis of rotation of the workpiece was varied from 30° to 90° in the operation of finally forming this wall.

The wall of the workpiece was bent in accordance with the radius corresponding to the radius of free bend R=13 mm.

The shape of the recess turned out to be conical, which did not correspond to the predetermined shape, due to the excessive speed of the pressing tool travel with respect to the speed of the rolling tool travel.

EXAMPLE 9

(Comparative)

A tubular workpiece of a structural steel containing about 0.2 percent of carbon was deformed in order to obtain a flat end face wall having a cylindrical neck with a diameter of 40 mm and a depth of 45 mm. The diameter of the workpiece was equal to $D_e$=108 mm and the wall thickness was equal to t=4 mm. The workpiece processed was heated to a temperature of 1000° C. Further processing was carried out in the same succession as described in the Example 1 with the following parameters:

n=375 r.p.m.;

D=65 mm;

$\phi$=30°;

$V_o$=2 mm/s;

$V_T$=10 mm/s.

The inclination angle between the generating line of the cone of the end face wall and the axis of rotation of the workpiece was varied from 30° to 90° in the operation of finally forming this wall.

The wall of the workpiece was bent in accordance with the radius corresponding to the radius of free bend R=13 mm.

The too low speed of the pressing tool travel with respect to the speed of the rolling tool travel resulted in that the shape of the obtained recess and of the end face did not correspond to the predetermined one; there were observed ruptures in the wall of the recess and on the surface of the end face were wrinkles and bulgings.

Figure 10:
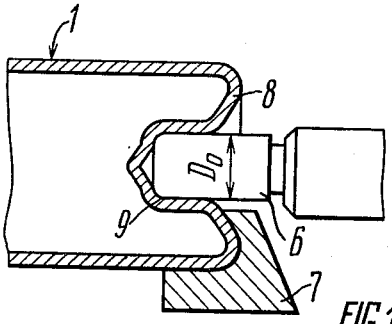
Figure 11:
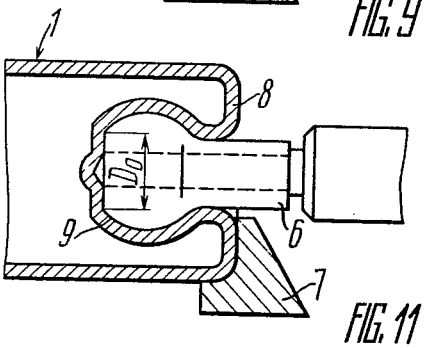

The above described examples of practicing the invention show the results of the experiments carried out by a laboratory of our institute in connection with a research for ways of manufacturing the all-in-one bodies of conveyor rollers. In connection with the above field of investigation, we first of all were interested in forming flat and conical end face walls having cylindrical or conical recesses in steel workpieces of diameters from 50 mm to 150 mm and of ratios of the wall thickness to diameter from 0.025 to 0.040. However, there is no reason to think that the above described method of forming an end face wall having a concentric recess in a tubular workpiece may find an application exclusively for the above conditions. It is quite obvious that it may be employed with tubular workpieces made of any forgeable metal or alloy as bronze, brass, aluminum, etc. It is also obvious that there is no principal difference in forming end face walls and recesses practically of any geometrical shape, for example an end face wall in the form of a cone whose apex is directed inwardly, as in FIG. 10, or a recess in the form of a body of revolution with a curvilinear generatrix as shown in FIG. 11 (in this case the tool 6 is a conventional demountable mandrel, see, for example, V. G. Kaporovich, "Obkatka v proizvodstve metalloizdely" (Rolling in Metal Products Manufacture/, 1973, Moscow, "Mashinostroenie" Publishing House, p. 83, FIG. 35).

It should be noted that the above described method may be carried out in a somewhat alternate way as compared to the above embodiments.

For instance, deforming the side wall of a tubular workpiece with forming a vault and preforming an end face wall with forming a flat area may be carried out beforehand as an individual step by means of the same, or any other, equipment known in the art and suitable for the purpose, in particular by means of shaping with a forging press. A conical shape is the most preferable here, however a side surface of a preformed end face wall may be shaped into, for example, a body of revolution with a curvilinear generatrix (convex or concave). Further, finally forming an end face wall may be carried out by rolling with feeding the tool not tangentially, as described, but in the direction parallel to the axis of rotation of the workpiece (see, for example, FIG. 10). As for the tool of rolling, it may be formed otherwise than described and may be, for example, a known in the art rolling tool of a lever type.

It should be also noted that tangentially rolling the cone in finally forming an end face wall may go on in a different succession than described thereabove. Moreover, the step of rolling with travelling the generating line in parallel is not necessary. Further, if forming a recess of a predetermined depth requires somewhat more material than the amount which may be fed by rolling the preformed end face wall, the missing amount of material may be "borrowed" from the side wall being subjected to the operation of rolling in the same way (in the direction to the zone of pressing).

Besides the above-mentioned, various changes and additions may be made in the mode of practice of the above described method without departing from the spirit and the scope of the invention as set forth in the appended claims.

INDUSTRIAL APPLICABILITY

The widest application of the invention is the production of all-in-one bodies of belt conveyor rollers. The invention may also find its application in the production of vessels, having inside necks, or other hollow articles having analogous interiors.

The above-described method makes it possible to form in a tubular workpiece an end face wall having a concentric recess of various geometrical shapes in a wide range of dimensions and at a high efficiency.

We claim:

1. A method of forming a face wall having a concentric recess in a tubular workpiece having an axis, said method comprising:

deforming the side wall at an end of the workpiece in the direction of closing the end edges to form a vault having an open end and a closed end;

forming a face wall at the closed end of the vault;

forming a recess in the face wall of the vault by pressing an area of the face wall into the inside of the workpiece by means of a pressing tool conforming to the shape and to the dimensions of the recess; and finally forming the closed end of the vault simultaneously with the forming of the recess by externally rolling the workpiece by means of a rolling tool, wherein the closed end of the vault has an outer diameter exceeding that of the bottom portion of the recess by a value of 2R to 3R, where R is the radius of a free bend of the workpiece end adjacent to the recess.

2. The method as claimed in claim 1, wherein final formation of the end face wall is carried out by externally and tangentially rolling the workpiece about its axis.

3. The method as claimed in claim 1, wherein the step of finally forming the face wall is carried out by effecting a simultaneous and synchronous movement of said pressing tool and said rolling tool, the ratio of the feed rate of the pressing tool to the feed rate of the rolling tool in processing a steel workpiece being within the range of 0.40 to 0.75.

4. The method as claimed in any of claims 1 to 3 including the step of shaping the closed end of the vault into a truncated cone having an angle of inclination of the generating line relative to the axis of 30° to 40°.

* * * * *